US006371731B2

(12) United States Patent
Centers

(10) Patent No.: US 6,371,731 B2
(45) Date of Patent: Apr. 16, 2002

(54) MULTISTAGE BLOWDOWN VALVE FOR A COMPRESSOR SYSTEM

(75) Inventor: Steven D. Centers, Daphne, AL (US)

(73) Assignee: Coltec Industries Inc, Charlotte, NC (US)

( * ) Notice: Subject to any disclaimer, the term of this patent is extended or adjusted under 35 U.S.C. 154(b) by 0 days.

(21) Appl. No.: 09/892,587

(22) Filed: Jun. 27, 2001

Related U.S. Application Data

(63) Continuation of application No. 09/422,284, filed on Oct. 21, 1999, which is a continuation-in-part of application No. 09/179,523, filed on Oct. 27, 1998, now Pat. No. 6,102,665.

(60) Provisional application No. 60/066,008, filed on Oct. 28, 1997.

(51) Int. Cl.[7] ..... F04B 49/00

(52) U.S. Cl. ..... 417/18

(58) Field of Search ..... 417/18, 283, 307, 417/308; 137/630.19, 625.34, 3, 889.3, 115.16, 115.21; 91/418, 503, 378, 437; 123/506; 251/324, 44

(56) References Cited

U.S. PATENT DOCUMENTS

| | | | | |
|---|---|---|---|---|
| 3,260,444 A | | 7/1966 | Williams et al. | |
| 3,756,753 A | | 9/1973 | Persson et al. | |
| 3,927,708 A | * | 12/1975 | Hulme | 152/418 |
| 3,936,239 A | | 2/1976 | Shaw | |
| 4,076,468 A | | 2/1978 | Persson et al. | |
| 4,084,618 A | * | 4/1978 | Gurries | 137/625.48 |
| 4,105,064 A | * | 8/1978 | Toro et al. | 165/233 |
| 4,155,535 A | * | 5/1979 | Seamone | 251/282 |
| 4,339,233 A | * | 7/1982 | Krueger | 417/317 |
| 4,646,785 A | * | 3/1987 | Ruedle et al. | 137/625.64 |
| 4,678,406 A | | 7/1987 | Pillis et al. | |
| 5,044,894 A | | 9/1991 | Field et al. | |
| 5,163,478 A | * | 11/1992 | Fries | 137/625.66 |
| 5,332,696 A | | 8/1994 | McKenzie | |
| 5,335,696 A | * | 8/1994 | McKenzie | 137/883 |
| 5,655,379 A | * | 8/1997 | Jaster et al. | 62/210 |
| 5,713,724 A | * | 2/1998 | Centers et al. | 417/53 |
| 5,738,497 A | | 4/1998 | Hensley | |
| 5,833,925 A | * | 11/1998 | Shu et al. | |
| 5,860,801 A | | 1/1999 | Timuska | |
| 6,053,421 A | * | 4/2000 | Chockley | 239/5 |
| 6,102,665 A | * | 8/2000 | Centers et al. | 417/18 |
| 6,283,716 B1 | | 9/2001 | Centers | |

* cited by examiner

*Primary Examiner*—Teresa Walberg
*Assistant Examiner*—Daniel Robinson
(74) *Attorney, Agent, or Firm*—Cummings & Lockwood

(57) ABSTRACT

A multi-stage blowdown valve is provided that uses a single control signal to simultaneously decompress the interstage and the second stage in a compressor system. The valve uses a series of sliding spools located linearly within a single bore to either prevent or allow fluid communication between two isolated passageways each having an inlet port and a discharge port. The valve, when used as a two stage blowdown valve in a multi-stage compressor system, can prevent compressor failure from occurring by ensuring that both the interstage and the second stages are decompressed. not only the interstage.

5 Claims, 5 Drawing Sheets

MULTISTAGE BLOWDOWN VALVE FOR A COMPRESSOR SYSTEM

RELATED APPLICATION

This application is a continuation of commonly owned U.S. patent application 09/422,284, filed Oct. 21, 1999, of Centers which is a continuation-in-part of commonly owned U.S. patent application Ser. No. 09/179,523, filed Oct. 27, 1998, of Centers et al. now U.S. Pat. No. 6,102,665, issued Aug. 15, 2000, which is a continuation-in-part of commonly owned U.S. Provisional Patent Application Serial No. 60/066,008, filed Oct. 28, 1997, of Centers et al., the disclosures of which are herein incorporated by reference.

FIELD OF THE INVENTION

The present application relates gene rally to a control valve. More specifically i t re lates t o a control valve used with compressors. Most specifically it relates to a blowdown valve used with one or more oil free two stage screw compressors.

BACKGROUND OF THE INVENTION

Power consumption for a two stage dry (oil free) screw compressor is significantly reduced if the interstage and the second stage are both decompressed when the compressor i s running unloaded. The problem with decompressing both stages. however, is that if the second stage blowdown valve malfunctions. the interstage blowdown valve will decompress the interstage and leave a large differential pressure on the second stage. This large differential pressure will raise the temperature of the second stage, possibly leading to compressor failured.

Previous compressors avoided the above problem by only unloading pressure from the second stage and not from both stages. The disadvantage however, of unloading pressure only from the second stage when running the compressor unloaded is that the compressor's power consumption is greater than if both stages are unloaded.

Previous valve mechanisms for compressors have not adequately addressed the problem of simultaneously decompressing two isolated stages. U.S. Pat. No. 3,260,444 to Williams discloses valve mechanisms 104 and 110 which are controlled by the same control line 158 and operate in a similar manner. With valve 104, for example, control line 158 can move piston 130 to control whether pipe 106 is in communication with pipe 113 or pipe 102. The disadvantage with using these valves as blowdown valves for a two stage compressor is that if one valve should malfunction, the other valve may continue to function, possibly leading to compressor failure.

What is desired, therefore, is a reliable mechanism for a two stage dry screw compressor to decompress the interstage blowdown valve when the second stage blowdown valve is activated.

SUMMARY OF THE INVENTION

Accordingly, it is a primary object of the present invention to provide a blowdown valve for two stages of a multi-stage compressor such that the valve reliably decompresses the interstage when the second stage is decompressed.

The object of the invention is achieved by a blowdown valve that uses a single control signal to simultaneously decompress the interstage when the second stage is decompressed. The valve uses a series of sliding spools located linearly within a single bore to either prevent or allow fluid communication between two isolated passageways each having an inlet port and a discharge port. The valve can be reliably used as a two stage blowdown valve in a multi-stage compressor sv'stem.

DETAILED DESCRIPTION OF THE INVENTION

Figure 1A:
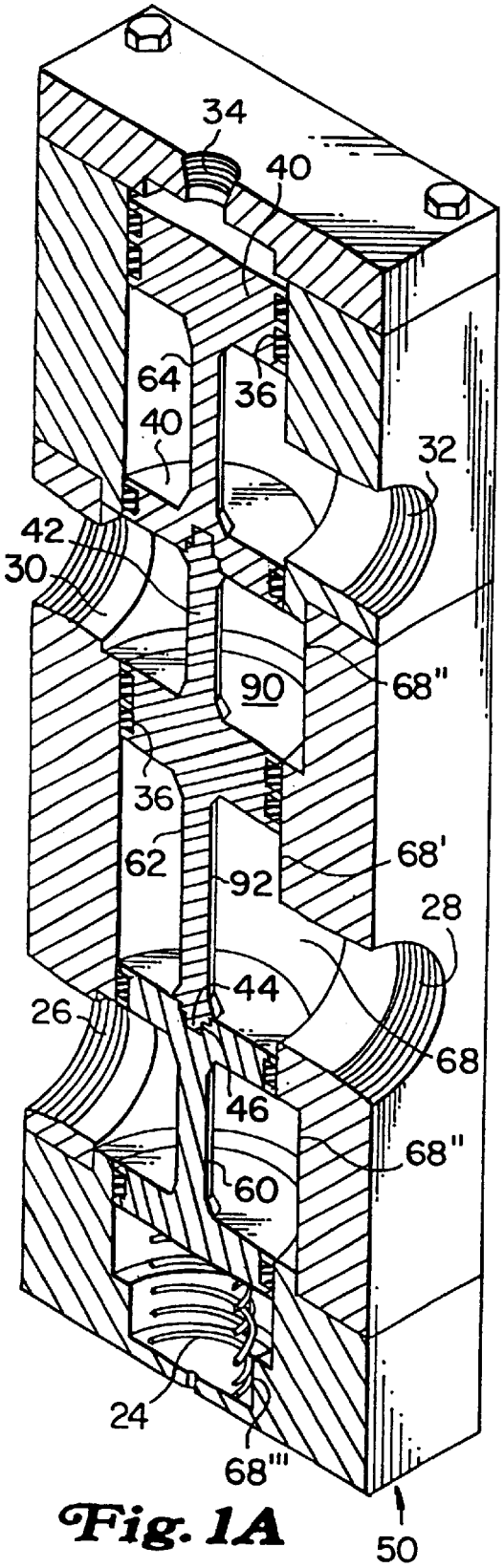
FIGS. 1A and 1B each show an isometric cross-sectional view of the multistage blowdown valve of the present invention wherein the valve is in a closed position and an open position, respectively.
Figure 1B:
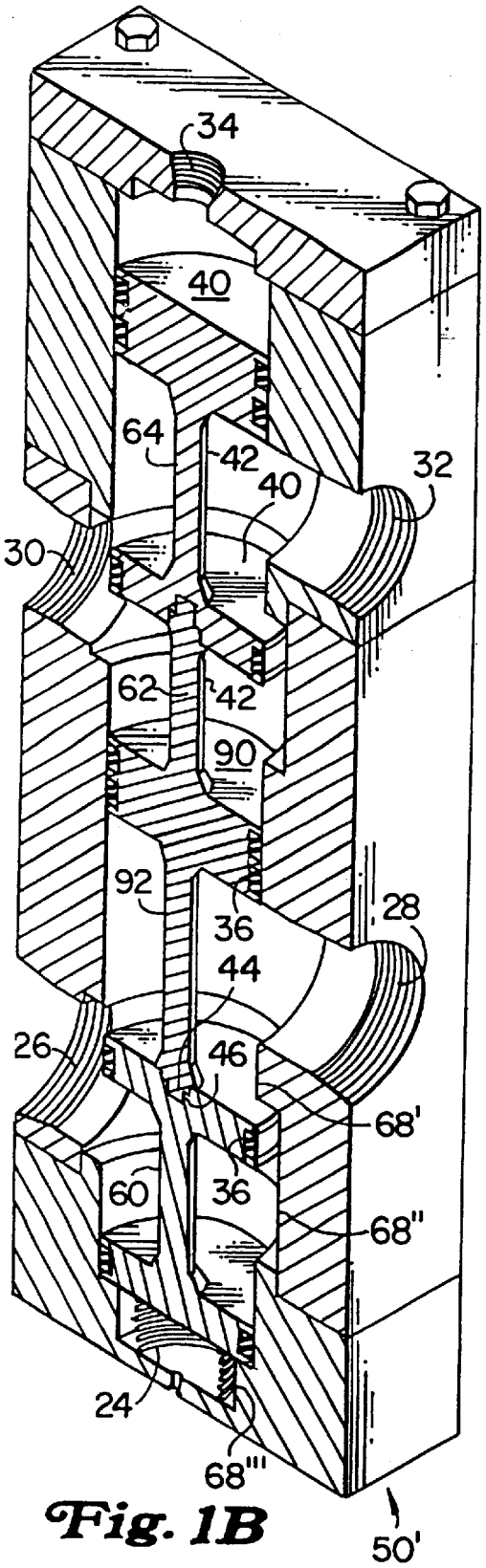

FIGS. 1A and 1B show the preferred embodiment for the multistage blowdown valve 50 of the present invention. Referring to these figures., the multistage blowdown valve 50 has two inlet ports, 26, 30 and two discharge ports 28, 32. When the valve 50 is in a closed position as shown in FIG. 1A. all ports 26, 28. 30 and 32 are fluidly isolated from one another. When the valve 50' is in an open position as shown in FIG. 1B, inlet port 26 is in fluid communication only with discharge port 28 and inlet port 30 is in fluid communication only with discharge port 32. It should be apparent that the valve 50 could operate in a reverse direction with the inlet ports 26, 30 acting as discharge ports and discharge ports 28, 32 acting as inlet ports.

The multistage blowdown valve 50 has a main bore 68 that can have a single diameter, but preferably has three diameters 68', 68" and 68'". Larger diameter 68" facilitates a larger volume of fluid passage through the valve and also prolongs the life of the rings 36. Thus, for example, the life of ring 36 on spool 17 will be prolonged by avoiding repeated contact with the edges of inlet 26 as the spool reciprocates through the bore 14. The smaller diameter 68'" helps to center the spring 24 within the bore 68.

Within the bore 68 are a plurality of spools 60. 62. and 64 that linearlv abut each other within the bore. Spools 60 and 64 each have a leg portion 42 bounded by two head portions 40. Spool 62 has one head portion 40 bounded by two leg portions 42. Adjacent spools are preferably coupled through the use of a mortise and a tenon. For example, each leg portion 42 of spool 62 can have a tenon 44 for fitting into a mortise 46 in a head portion of adjacent spools 60 and 64.

Each head portion 40 further preferably has one or more rubber rings 36 inserted into a corresponding annular groove in the head portion such that each spool has airtight contact within the bore 14 as the spools move within the bore. The preferred type of ring used for ring 36 on the spools 16–20 or 60. 62 and 64 are sometimes referred to as V-rings or U-rings which refer to the ability of the ring to fold when placed in a bore. The beneficial properties of the folding ring design include reduced sticking when the spools move in bore 14, reduced sliding forces which allow lower and reapeatable control forces, improved sealing by the ring unfolding under pressure, and durability in that all of the desirable properties of the folding ring continue even after partial ring wear. The folding ring design also provides reliable operation when the spools move within the various diameters of the bore, for example, from diameter 14' to 14" or 68' to 68" and then back again.

The movement of spools 60, 62 and 64 is controlled through pneumatic pressure applied against the head 40 of spool 64 through control port 34. A spring 24 is located within the bore preferably at an opposite end of the control port 34 and extends laterally through the bore. The spring 24 abuts the head 40 from spool 60 to bias the valve to a closed position (see FIG. 1A). Furthermore, spring means. such as compression spring 24, counteracts the force of the control signal when the valve is in an open position (see FIG. 1B) and returns the blowdown valve to a closed position when the control signal is inactive. Alternatively, a tension spring and the control port could operate together at the same end of the bore, although those skilled in the art will realize that the control signal will operate in an inverse manner.

Figure 2A:
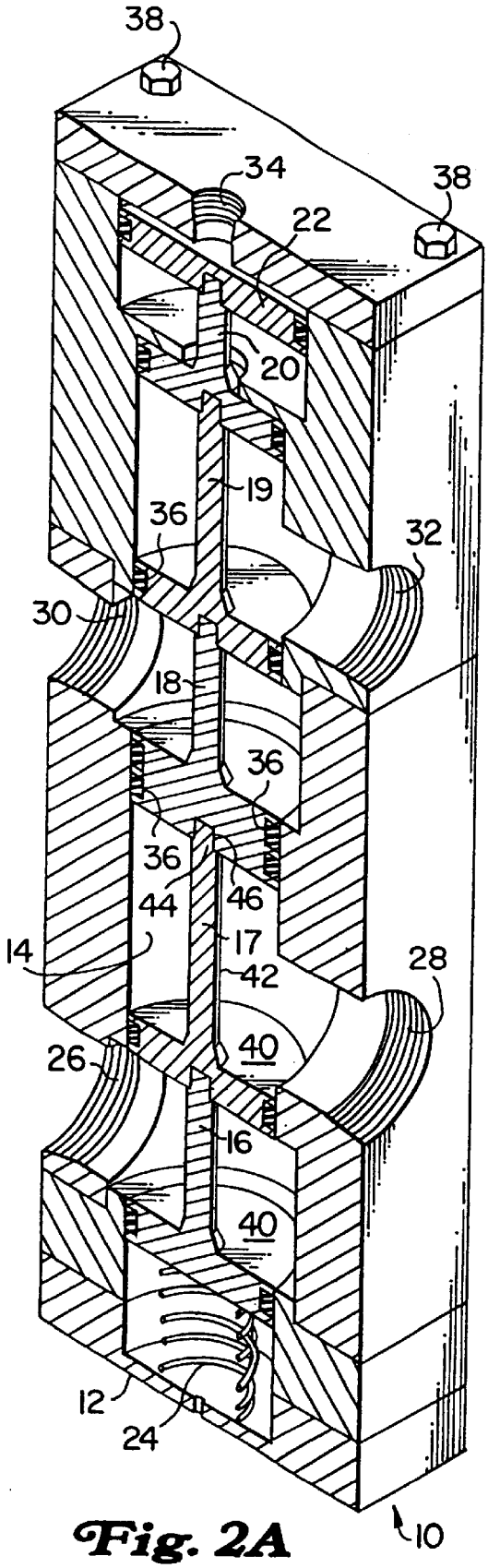
FIGS. 2A and 2B each show an isometric cross-sectional view of a second embodiment of the multistage blowdown valve of the present invention wherein the valve is in a closed position and an open position. respectively.
Figure 2B:
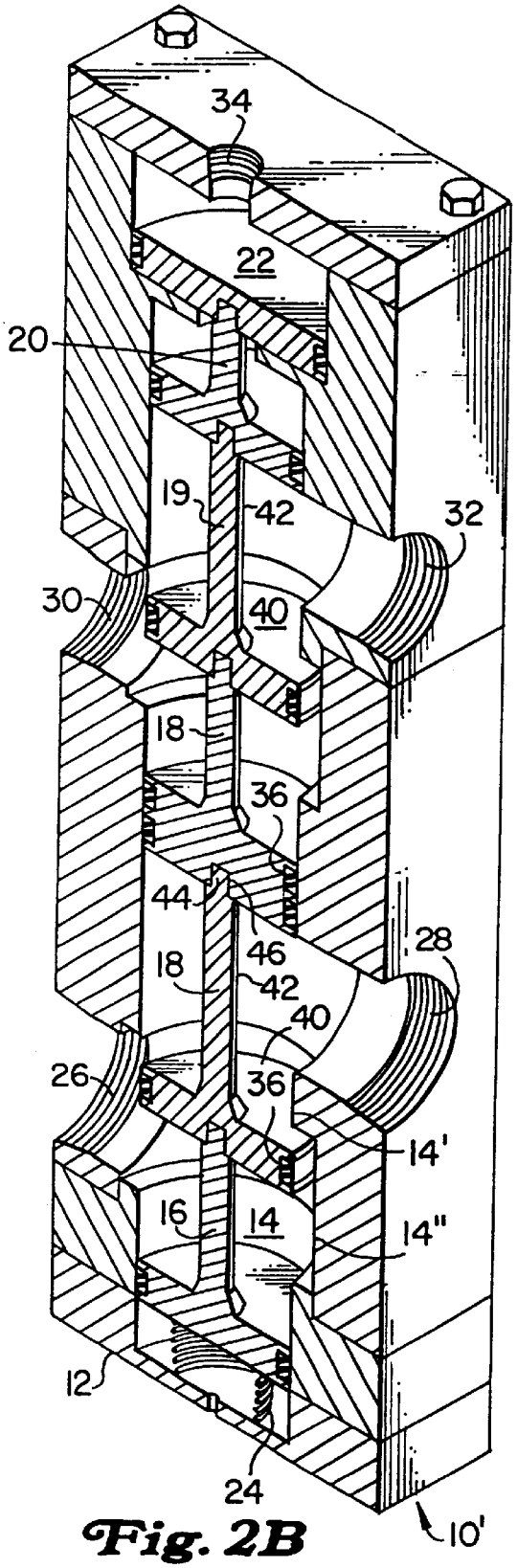
Figure 3A:
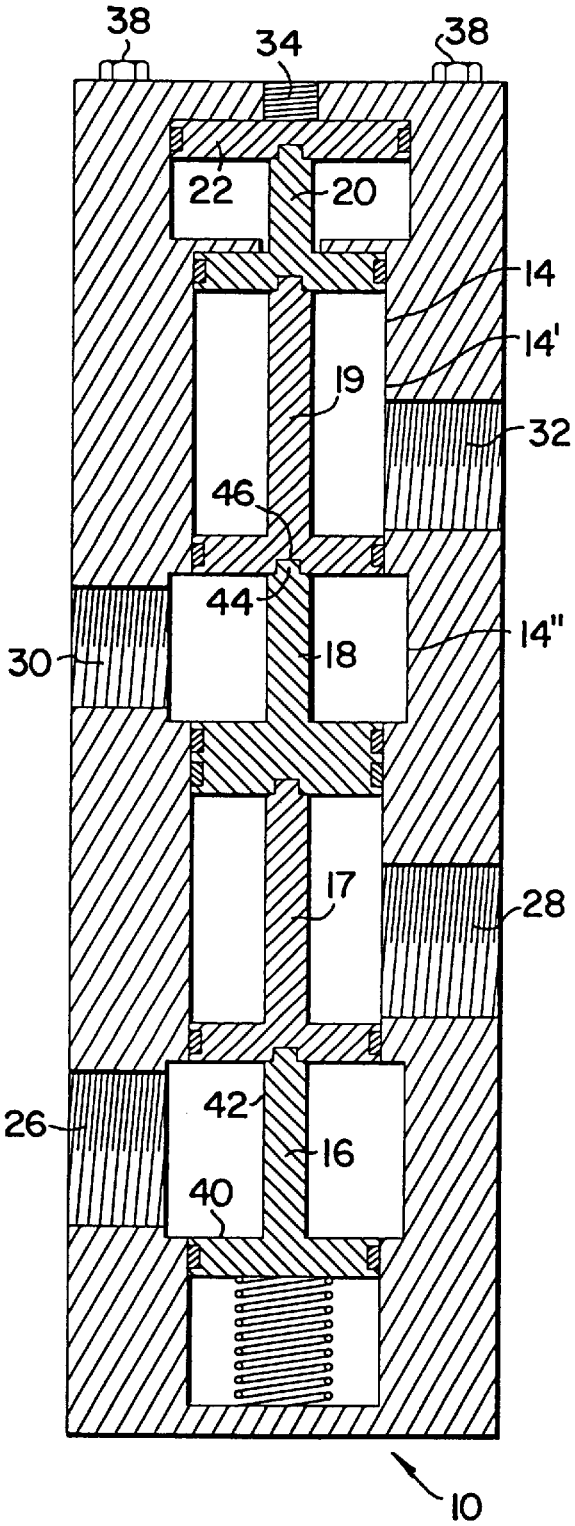
FIGS. 3A and 3B are front cross-sectional and side cross-sectional views, respectively, of the valve of FIG. 2A.
Figure 3B:
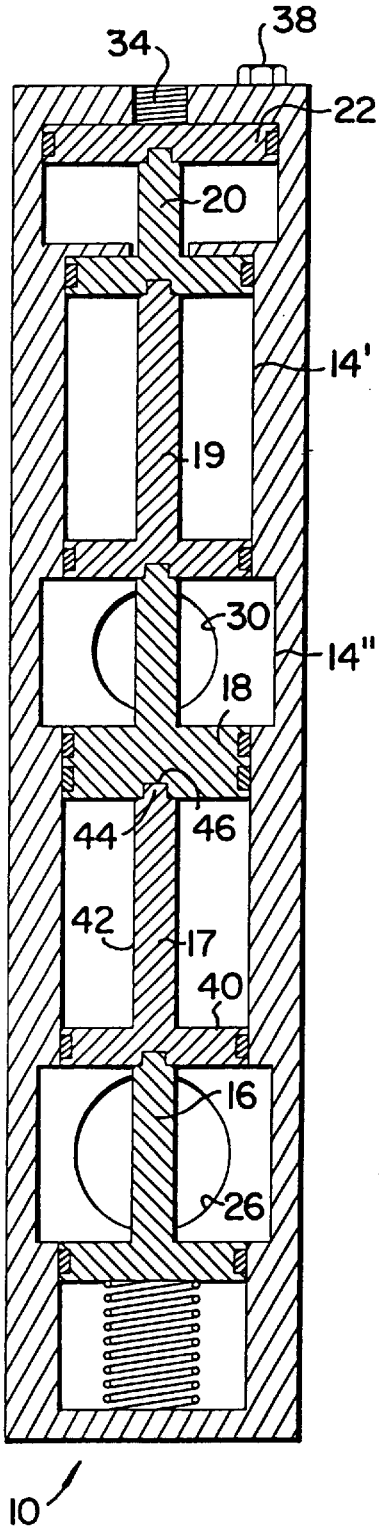

FIGS. 2A, 2B, 3A and 3B show another embodiment of the multistage blowdown valve 10 and 10' of the present invention. FIG. 2B shows the blowdown valve 10' in an open position and FIGS. 2A. 3A and 3B show the blowdown valve 10 in a closed position. The multistage blowdown valve 10 generally differs from multistage blowdown valve 50 in that it has a different configuration of spools 16–20 and does not have a smaller bore near the compression spring 24. Instead. the multistage blowdown valve 10 has a main bore 14 with two diameters 14' and 14".

Referring to FIGS. 2A, 2B. 3A and 3B. within bore 14 are a plurality of spools 16–20 that linearly abut each other within the bore. Each spool 16–20 has a leg portion 42 and a head portion 40. Adjacent spools are preferably coupled through the use of a mortise and a tenon. For example, each head portion 40 of each spool 16–20 can have a mortise 46 for fitedly receiving a tenon 44 on the leg portion 42 of the adjacent spool.

Although the present invention uses a plurality of spools within the bore, a single spool could also be used for the same function. However, a plurality of individual spools 16–20 or 60, 62 and 64 are preferably used because they create a better seal by reacting to both the control pressure and internal pressures produced from the inlet ports. However, it is more preferable to use the spools 60, 62 and 64 shown in FIGS. 1A and 1B because less linear deviations will occur during spool movement than with the configuration of spools 16–20 shown in FIGS. 2A and 2B.

It should be apparent to those skilled in the art that although the valve described herein is for a two-stage compressor the valve can be adapted for compressors having three or more stages. To create a multi-stage blowdown valve, the valve described herein merely needs a longer bore, additional spools and extra inlet and discharge ports.

Figure 4:
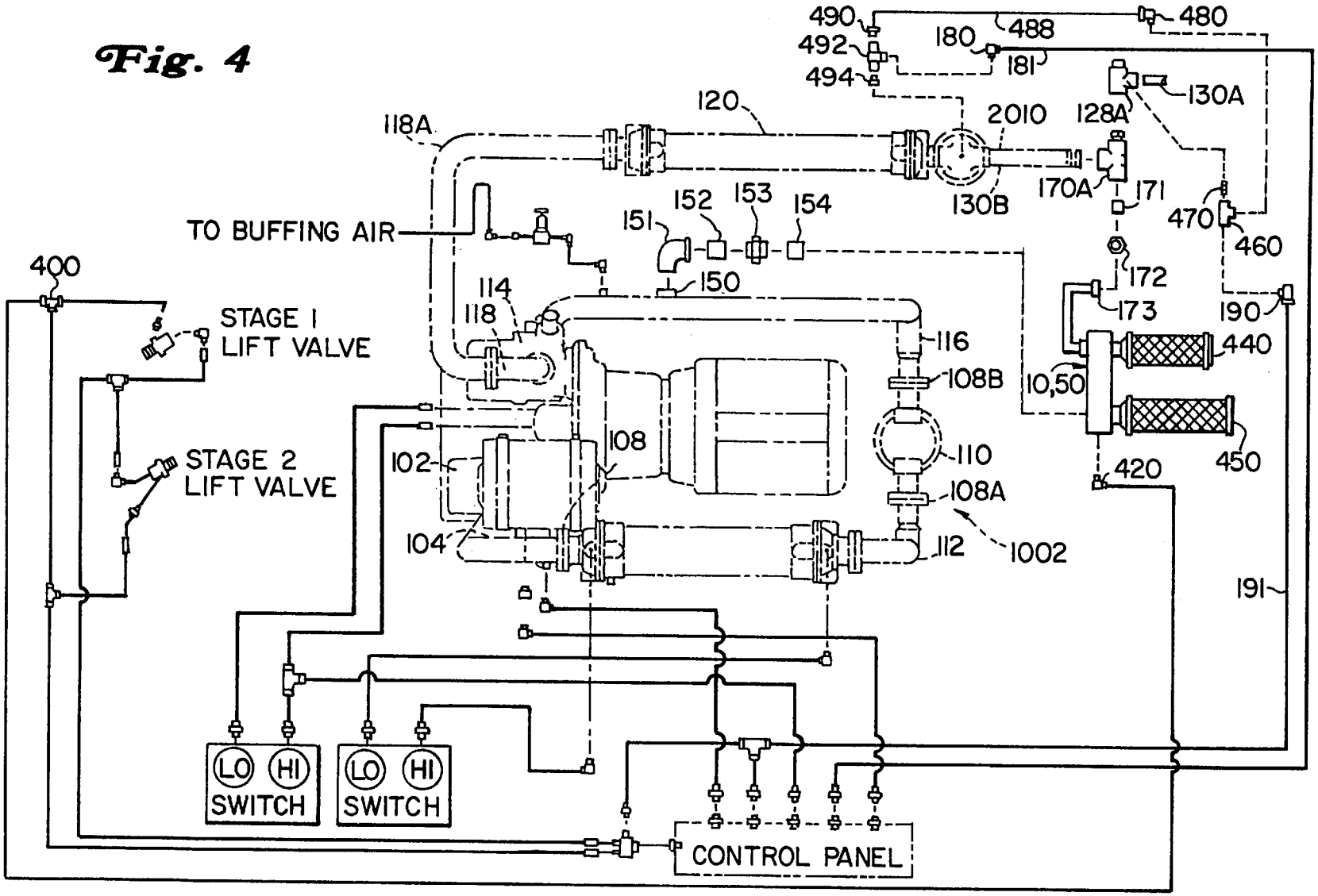
FIG. 4 is a diagram showing the multistage blow down valve of FIGS. 1A and 1B used with a compressor system.
Figure 5:
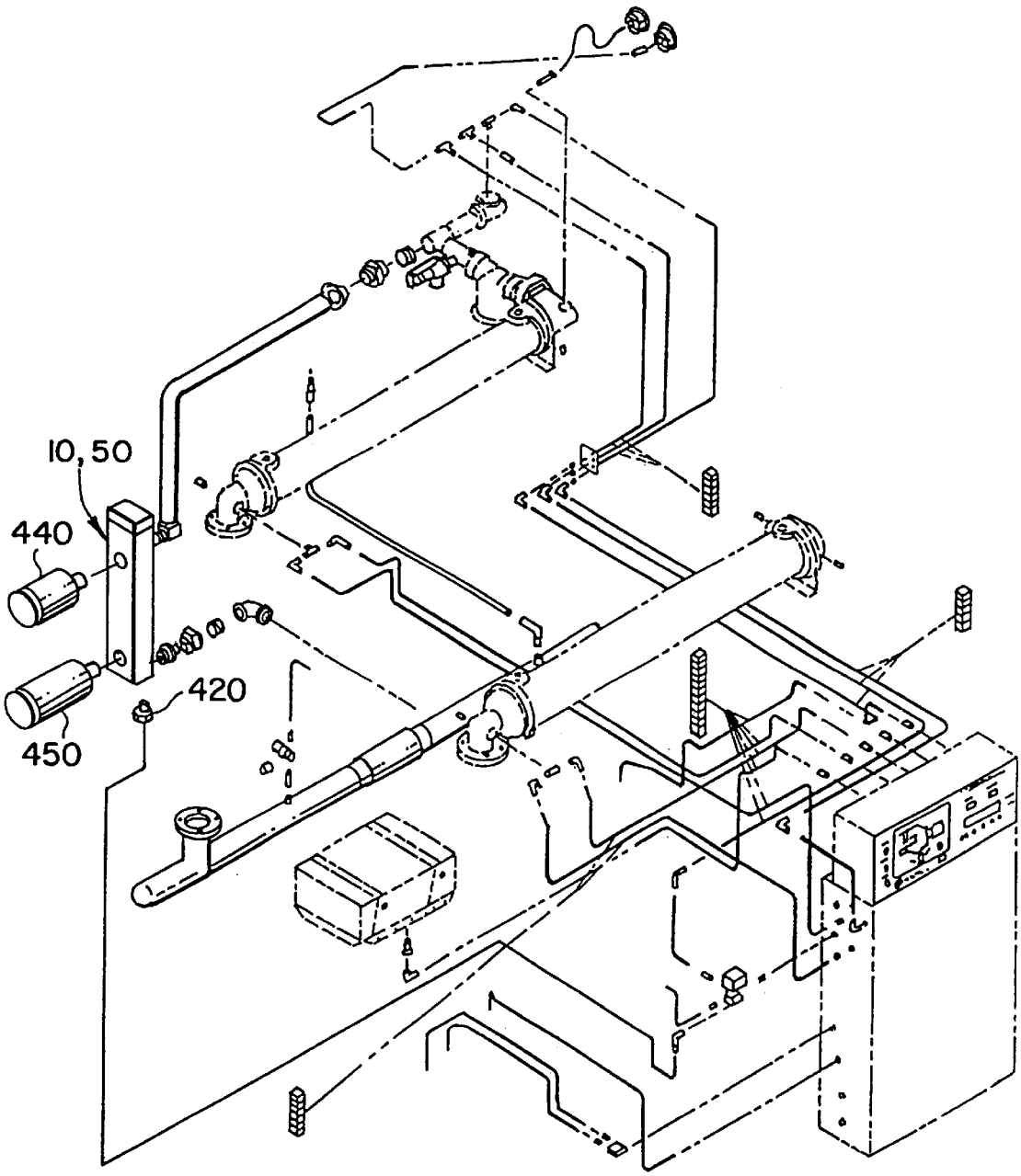
FIG. 5 is a partial exploded view of the improved operative connections of a compressor system of FIG. 4 used with the multistage blowdown valve of FIGS. 1A and 1B.

FIGS. 4 and 5 show the multistage blowdown valve used with a dual stage compressor system 1002. The dual stage compressor system 1002 described herein is best described in U.S. patent application Ser. No. 09/179,523. The multistage blowdown valve 10 can have many applications and be used with many compressor systems. Thus, it should be understood that the compressor system 1002 described herein is merely given as an example and not meant to be limiting.

The operation of compressor system 1002 will now be briefly described. Referring to FIG. 4, the first-stage compressor 102 compresses the air to approximately thirty (30) psi. The compressed air is transmitted from the first stage compressor 102 into the innerstage piping 104. The compressed air flows through the piping 104 to an innerstage cooler 106. The cooler 106 drops the air temperature by approximately three hundred degrees Fahrenheit (300° F). The cooler 106 is connected to the discharge of the first stage compressor 102 via a coupling plate 108.

The compressed air is transmitted through the innerstage cooler 106 into another innerstage pipe 112. The pipe 112 is connected to a moisture trap 110 via coupling plates 108A. The moisture trap 110 is connected to the innerstage piping that leads to the second stage compressor 114 via innerstage pipe 116 which is also connected to the moisture trap 110 via coupling plates 108B.

This compressed air is transmitted into the inlet of the second stage compressor 114. The second stage compressor 114 compresses the air approximately another seventy (70) psi, which brings the air up to approximately one hundred (100) psi. The compressed air is transmitted from the second stage compressor 114 into the second stage compressor discharge pipe 118. The pipe 118 is connected to another discharge pipe 118A leading to a compressor package discharge cooler 120. The cooler 120 again drops the temperature of the compressed air transmitted therethrough by approximately three hundred degrees Fahrenheit (300° F).

Innerstage pipe 116 has a bung 150 welded thereto, which connects the innerstage pipe 116 to the inlet port 26 of the multistage blowdown valve 10. The connection to inlet port 26 is through a pipe elbow 151, pipe nipple 152, pipe coupling 153, and pipe nipple 154. A muffler 450 is attached to the discharge port 28 of the blowdown valve 10. The purpose of the muffler 450 is to reduce the amount of noise that would be created when any trapped air pressure is vented to atmosphere.

Discharge pipe 130B is attached to the moisture trap 126, has a T shaped bung 170A welded thereto, and has a package temperature probe 2010 is located within it. One end of the T-shaped bung 170A has one end of a pipe elbow 128A coupled thereto. The other end of the pipe elbow 128A is coupled to the discharge pipe 130A. A pipe nipple 171 is connected to the other end of the bung 170A, which is threaded onto a coupling 172, which is connected to pipe nipple 173. The inlet port 30 of the multistage blowdown valve 10 is connected to the pipe nipple 173. The discharge port 32 of valve 10 has an exhaust muffler 440 operatively connected thereto. The muffler 440 reduces the amount of noise created when any trapped air pressure is vented to atmosphere.

The multistage blowdown valve 10 of the present invention will exhaust any trapped pressure at shutdown or unload of the two stage compressor 1002 that might be trapped in innerstage pipe 116 and in the discharge piping 130B from the second stage compressor 114. Due to the integration of the interstage and second stage blowdown valves, the interstage and the second stage will be decompressed simultaneously. Therefore, if the second stage blowdown valve malfunctions and fails to open, the innerstage blowdown valve will remain open thus averting possible compressor failure.

Additional modifications need to be made to the compressor system 1002 to use it with the multistage blowdown valve 10 of the present invention. Tubing elbow 180, which was attached to the moisture trap 126, is now attached to a shuttle check valve 492. One side of the shuttle check valve 492 is connected to the moisture trap 126 through a pipe fitting 494. The other side of the shuttle check valve 492 is connected to a tubing elbow 490 which is connected to tubing 488. Tubing 488 has an elbow 480 connected to its other end which is connected to a first end of tubing T 460. Previously, tube fitting 190 was operatively connected to check valve 128A, but is now connected to a second end of tubing T 460. The third end of tubing T 460 is connected through a pipe fitting 470 to check valve 128A.

The dual blowdown valve 10, 50 of the present invention lowers the pressure ratio across the second stage, i.e., the value of the pressure across the second stage minus the pressure across the interstage, divided by the value of the pressure across the interstage. Through testing, it has been determined that using the dual blowdown valve of the present invention can lower the second stage pressure ratio under normal operating conditions from a value above six to a value below three.

One of the benefits of maintaining a low-pressure ratio across the second stage compressor during normal operations is that it lowers operating temperatures in the second stage compressor. Tests of the dual blowdown concept have shown that a standard blowdown system had a second stage compressor discharge as high as 360 degrees F during normal cycling operation. Under the same cycling operation the dual blowdown system had a maximum second stage compressor discharge temperature of 295 degrees F. In this test, the dual blowdown system ran 22 percent cooler than the standard system. These cooler operating temperatures obtained from using the dual blowdown valve 10, 50 can lead to a longer compressor lifespan.

It should be understood that the foregoing is illustrative and not limiting and that obvious modifications may be made by those skilled in the art without departing from the spirit of the invention. Accordingly. reference should be made primarily to the accompanying claims. rather than the foregoing specification. to determine the scope of the invention.

What is claimed is:

1. A method for controlling a single or a network of oil less, two stage screw compressor packages, operatively connected to a pressure system in which pressure is to be maintained within a desired pressure range, for controlling the operation of the single or the network of screw compressor packages, the method comprising the steps of:

providing at least one or a network of oil less, two stage screw compressor packages;

operatively connecting the at least one or a network of oil less, two stage screw compressor packages to a pressure system in which pressure is to be maintained within a predetermined range of possible pressures;

operatively connecting an electronic control system to at least one two stage screw compressor package;

controlling the operation of the at least one or a network of oil less, two stage screw compressor packages by;

determining the pressure exiting the first and the second screw compressor stages;

comparing the determined pressure exiting the first screw compressor and the second screw compressor stages with a predetermined range of possible pressures; and if the determined pressure exiting either the first or the second screw compressor stages equals or exceeds the predetermined range of possible pressures, shutting down the screw compressor package before the screw compressor package is damaged; and following the shutting down of the screw compressor package, simultaneously releasing pressure within a first and a second compressor stage by a single valve means controlled by a single control signal.

2. The method of claim 1 further comprising the steps of:

determining the temperature of the gas exiting the first and the second screw compressor stages;

comparing the determined temperature exiting the first screw compressor and the screw second compressor stages with a predetermined temperature limit;

shutting the screw compressor package down before the package is damaged, if the exiting temperatures exceed such predetermined temperature; and following the shutting down of the screw compressor package, simultaneously releasing pressure within a first and a second compressor stage by a single valve means controlled by a single control signal.

3. The method of claim 1 further comprising the steps of:

cooling the air prior to the air entering the second stage screw compressor by operatively positioning at least one cooling means between the stage one screw compressor and the stage two screw compressor;

cooling the air prior to the air entering the end user air system by operatively positioning at least a second cooling means between the stage two screw compressor exit and the compressor package exit;

establishing a high predetermined temperature limit for the temperature of the air exiting each cooling means;

measuring the temperature of the air exiting each cooling means by operatively connecting measuring means to each cooling means;

if the exiting temperatures exceed a predetermined temperature limit, shutting the screw compressor package down before the package is damaged; and following the shutting down of the screw compressor package, simultaneously releasing pressure within a first and a second compressor stage by a single valve means controlled by a single control signal.

4. The method of claim 1 further comprising the steps of:

operatively positioning lubricating oil containing means in the stage one screw compressor and the stage two screw compressor for lubricating parts isolated from each screw compressor compression chamber;

measuring the oil pressure of both the stage one screw compressor and the stage two screw compressors by operatively connecting measuring means to the each lubricating oil containing means;

establishing a range of predetermined operating oil pressures;

if the oil pressure deviates from the predetermined oil pressure range, shutting the screw compressor package down before the package is damaged; and following the shutting down of the screw compressor package, simultaneously releasing pressure within a first and a second compressor stage by a single valve means controlled by a single control signal.

5. The method of claim 1 further comprising the steps of:

measuring the pressure of the air exiting the screw compressor package after the second stage cooling means;

measuring the temperature of the air exiting the screw compressor package after the second stage cooling means;

establishing a range of screw compressor package discharge temperatures and pressures;

if either the temperature or the pressure exceeds a predetermined limit, shutting down the screw compressor package; and following the shutting down of the screw compressor package, simultaneously releasing pressure within a first and a second compressor stage by a single valve means controlled by a single control signal.

* * * * *